US007207826B1

(12) United States Patent
Yang

(10) Patent No.: US 7,207,826 B1
(45) Date of Patent: Apr. 24, 2007

(54) PLUG FASTENING DEVICE

(75) Inventor: Chun-Yu Yang, Taipei (TW)

(73) Assignee: Inventec Corporation (TW)

( * ) Notice: Subject to any disclaimer, the term of this patent is extended or adjusted under 35 U.S.C. 154(b) by 0 days.

(21) Appl. No.: 11/262,276

(22) Filed: Oct. 28, 2005

(51) Int. Cl.
*H01R 13/64* (2006.01)

(52) U.S. Cl. ..... 439/373; 439/371

(58) Field of Classification Search ..... 439/373, 439/371

See application file for complete search history.

(56) References Cited

U.S. PATENT DOCUMENTS 4,768,974 A * 9/1988 Cowan et al. ..... 439/371
4,898,542 A * 2/1990 Jones, Jr. ..... 439/371
5,167,524 A * 12/1992 Falcon et al. ..... 439/371
5,567,172 A * 10/1996 Thibault et al. ..... 439/371
5,655,924 A * 8/1997 Cross et al. ..... 439/373
5,766,032 A * 6/1998 LaPointe et al. ..... 439/371
6,033,251 A * 3/2000 Cook ..... 439/369
6,491,539 B1 * 12/2002 Johnston ..... 439/373
6,802,725 B2 * 10/2004 Rowland et al. ..... 439/144

FOREIGN PATENT DOCUMENTS

TW 327481 7/1985
TW 209629 3/1998

* cited by examiner

*Primary Examiner*—Gary F. Paumen
(74) *Attorney, Agent, or Firm*—Peter F. Corless; Steven M. Jensen; Edwards Angell Palmer & Dodge LLP

(57) ABSTRACT

A plug fastening device applied to a socket-forming side having a first fixing portion is provided. The plug fastening device includes a fixing member and a binding member. The fixing member has at least one first coupling portion, and a second fixing portion for being fixed to the first fixing portion. The binding member is capable of binding an end of a plug, and has at least one second coupling portion for being coupled to the first coupling portion. As the binding member is applicable to all kinds of plugs with different specifications, the drawback in the prior art that the conventional plug fastening device cannot be universally used is overcome.

23 Claims, 4 Drawing Sheets

PLUG FASTENING DEVICE

FIELD OF THE INVENTION

The present invention relates to plug fastening devices, and more particularly, to a plug fastening device for preventing disconnection of a wire plug from a socket.

BACKGROUND OF THE INVENTION

By the development of computer technology, computers have played an important role in the human life. Personal computers are in widespread use for families, and powerful servers are adopted in the factories for 24-hour nonstop works such as computing, monitoring and the like to provide high competitiveness. Such factories therefore require sufficient and continuous supply of power.

The government offers a low power rate and a priority in power supply to the industry in order to enhance the industrial competitiveness, and the factory usually has a backup power supply system to minimize the effect of any power break. Besides failure in the supply of the public power, undesirably artificial or accidental disconnection of a plug of a power wire or signal wire from a socket on an operating machine also causes power break and adversely affects the operation of the factory.

The disconnection of the wire plug from the socket may lead to data loss or system damage for a personal computer and even system failure or breakdown for a server or a large industrial computer. In order to avoid such situation, a fastening structure is additionally provided on the socket or the wire plug to ensure the wire plug being fixed to the socket, and the fastening structure also allows the wire plug to be unplugged from the socket if necessary. Taiwanese Utility Model Publication Nos. 209629 and 327481 have respectively disclosed a plug fastening device for preventing disconnection of the plug from the socket.

The plug fastening device disclosed in Taiwanese Utility Model Publication No. 209629 comprises a positioning member having a sliding groove and provided on a power socket, and a coupling member capable of sliding upwardly and downwardly coupled to the sliding groove of the positioning member. The coupling member may further be coupled to two side edges of a plug to fix the plug to the power socket, and the plug can be unplugged from the power socket by sliding the coupling member upwardly. Although the plug fastening device is advantageous for preventing disconnection of the plug from the power socket and allowing separation therebetween if necessary, it needs to greatly modify the structure design of the power socket and is not applicable to all kinds of plugs with different specifications, making its industrial practicability low.

Referring to FIG. 1, the plug fastening device disclosed in Taiwanese Utility Model Publication No. 327481 comprises an elastic frame 1, and two openings 13 provided on a socket-forming side. The elastic frame 1 is formed by bending a steel thread to have two positioning hooks 11 at two ends thereof and a holding portion 12 located between the two positioning hooks 11. The socket-forming side is for example a back side of a casing of a computer host or server host. The socket is for example a socket for a power supplier in the host, and the plug is for example a plug of a power wire. The elastic frame 1 is coupled to the two openings 13 on the socket-forming side by the positioning hooks 11 and is fixed to a back portion of the plug by the holding portion 12. The holding portion 12 is capable of being turned with respect to the positioning hooks 11 as the pivot if necessary.

Although the above plug fastening device does not need to greatly modify the structure design of the socket, the elastic frame 1 is only applicable to the plug with a particular specification, such that the plug fastening device similarly cannot be universally used. That is, when the diameter of the power wire or the specification of the plug is changed, the holding portion 12 of the elastic frame 1 may no longer be able to properly hold the back portion of the plug, making the elastic frame 1 not applicable to all kinds of plugs with different specifications.

Moreover, the elastic frame 1 must have flexibility in deformation to form the two positioning hooks 11 that can be coupled to the two openings 13 on the socket-forming side, and the holding portion 12 between the two positioning hooks 11 also has the flexibility in deformation. When the power wire is pulled by a large force, it may possible cause elastic deformation of the holding portion 12 and disconnection of the plug from the socket.

Therefore, the problem to be solved here is to provide a plug fastening device to overcome the above drawbacks.

SUMMARY OF THE INVENTION

In light of the foregoing drawbacks in the prior art, an objective of the present invention is to provide a plug fastening device, which is applicable to all kinds of plugs with different specifications.

Another objective of the present invention is to provide a plug fastening device to ensure a plug being fixed to a socket.

In accordance with the above and other objectives, the present invention proposes a plug fastening device applied to a socket-forming side having a first fixing portion. The plug fastening device comprises a fixing member and a binding member. The fixing member has at least one first coupling portion, and a second fixing portion capable of being fixed to the first fixing portion. The binding member is capable of binding an end of a plug, and has at least one second coupling portion capable of being coupled to the first coupling portion.

In a preferred embodiment, the fixing member is for example a plate structure and has a plurality of first coupling portions spaced from each other, wherein the first coupling portions can be coupling holes having for example a gourd-like shape. The second fixing portion comprises a blocking portion provided at an end of the fixing member, and an elastic member provided at a side of the fixing member and adjacent to the blocking portion or two elastic members respectively provided at two sides of the fixing member and adjacent to the blocking portion.

The binding member comprises a plurality of second coupling portions connected to each other, wherein the second coupling portions can be coupling bumps having for example a spherical structure. The binding member further comprises at least one through hole distant from the second coupling portions and for the second coupling portions to pass therethrough. Preferably, the binding member comprises a plurality of through holes spaced from each other. The binding member further comprises an inversed-hook structure located between the second coupling portions and the through holes, wherein the inversed-hook structure has a saw-toothed shape. The binding member is capable of binding the end of the plug or a transmission wire at the end of the plug, wherein the transmission wire is a power wire or a signal wire. The first fixing portion is an opening formed on the socket-forming side; preferably, the opening has a slender rectangular shape.

In another preferred embodiment, the fixing member has a plurality of first coupling portions connected to each other, wherein the first coupling portions can be coupling bumps having for example a spherical structure. The binding member has a plurality of second coupling portions spaced from each other, wherein the second coupling portions can be coupling holes having for example a gourd-like shape.

The plug fastening device of the present invention utilizes the combination of the fixing member and the binding member to ensure the plug being fixed to the socket such that the plug cannot be unplugged from the socket at such status, thereby preventing undesirably artificial or accidental disconnection of the plug from the socket. Moreover, as the binding member can be freely bent to bind the end of the plug or the transmission wire at the end of the plug, it is applicable to all kinds of plugs or transmission wires with different specifications, such that the drawback in the prior art that the conventional plug fastening device cannot be universally used is overcome.

BRIEF DESCRIPTION OF THE DRAWINGS

The present invention can be more fully understood by reading the following detailed description of the preferred embodiments, with reference made to the accompanying drawings, wherein.

DETAILED DESCRIPTION OF THE PREFERRED EMBODIMENTS

Preferred embodiments of a plug fastening device proposed in the present invention are described as follows with reference to FIGS. 2 to 6. It should be noted that the drawings are simplified diagrams for only illustrating the basic components of the present invention and do not set a limitation to the number and shape of components that can be used in the present invention. The layout of components may be more complicated in practice.

Figure 1:
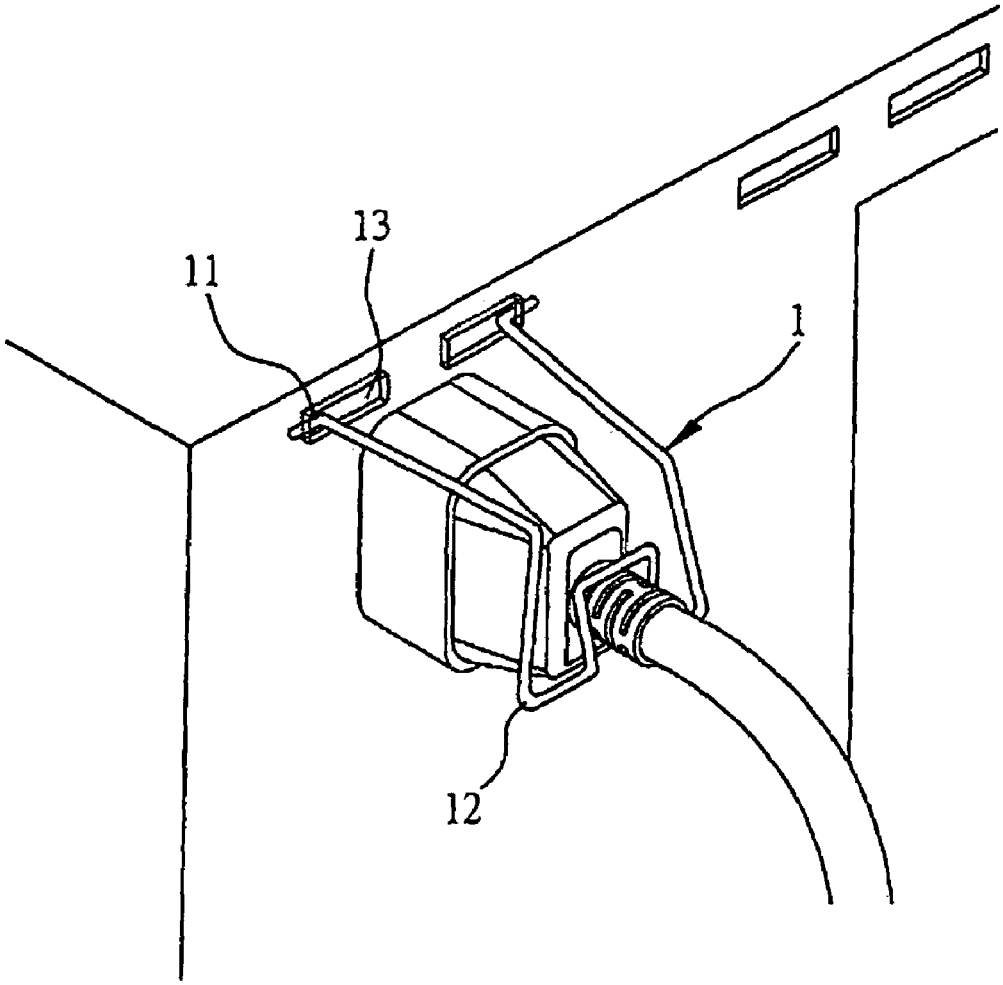
FIG. 1 (PRIOR ART)
FIG. 1 (PRIOR ART) is a schematic diagram showing a plug fastening device disclosed in Taiwanese Utility Model Publication No. 327481.
Figure 2:
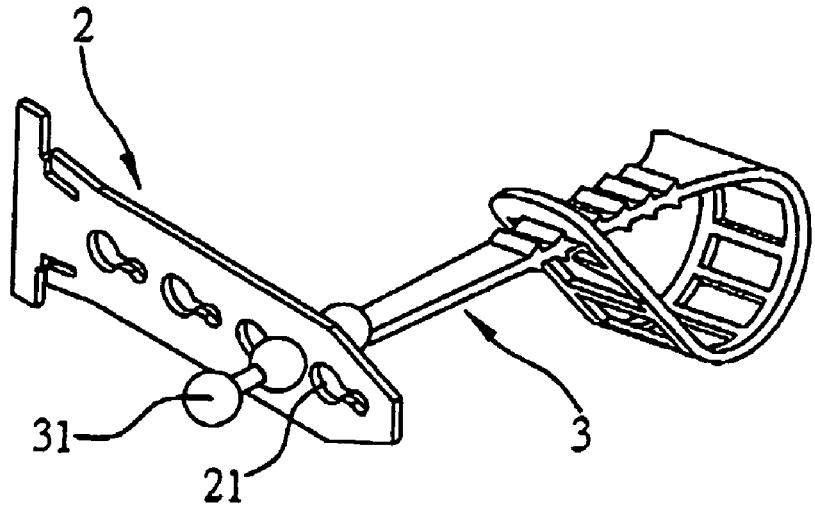
FIG. 2 is a schematic diagram showing a plug fastening device according to the present invention.

FIG. 2 is a schematic diagram showing the plug fastening device according to the present invention. The plug fastening device as shown in FIG. 2 comprises a fixing member 2 and a binding member 3. The fixing member 2 can be fixed to a socket-forming side, and has at least one first coupling portion 21 capable of being coupled to the binding member 3. The binding member 3 can bind and hold an end of a plug firmly, and has at least one second coupling portion 31 capable of being coupled to the first coupling portion 21.

Figure 3:
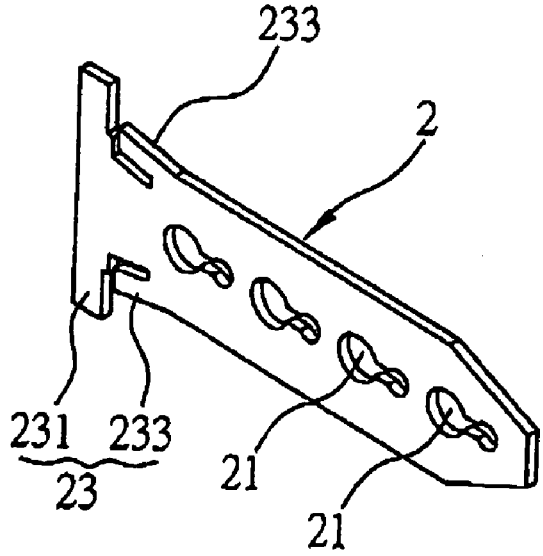
FIG. 3 is a schematic diagram showing a fixing member of the plug fastening device according to the present invention.

FIG. 3 is a schematic diagram showing the fixing member 2 of the plug fastening device according to the present invention. The fixing member 2 is for example a plate structure, which is preferably made of a plastic material and has appropriate strength, tenacity and elasticity. In this embodiment, the fixing member 2 comprises a plurality of first coupling portions 21 spaced from each other, and the first coupling portions 21 can be coupling holes having for example a gourd-like shape. The fixing member 2 further comprises a second fixing portion 23, wherein the second fixing portion 23 comprises a blocking portion 231 provided at an end of the fixing member 2 and two elastic members 233 respectively provided at two sides of the fixing member 2 and adjacent to the blocking portion 231. It should be noted that the present invention may also use only one elastic member to achieve the same fixing effect and is not particularly limited to the use of two elastic members 233 in this embodiment.

Figure 4:
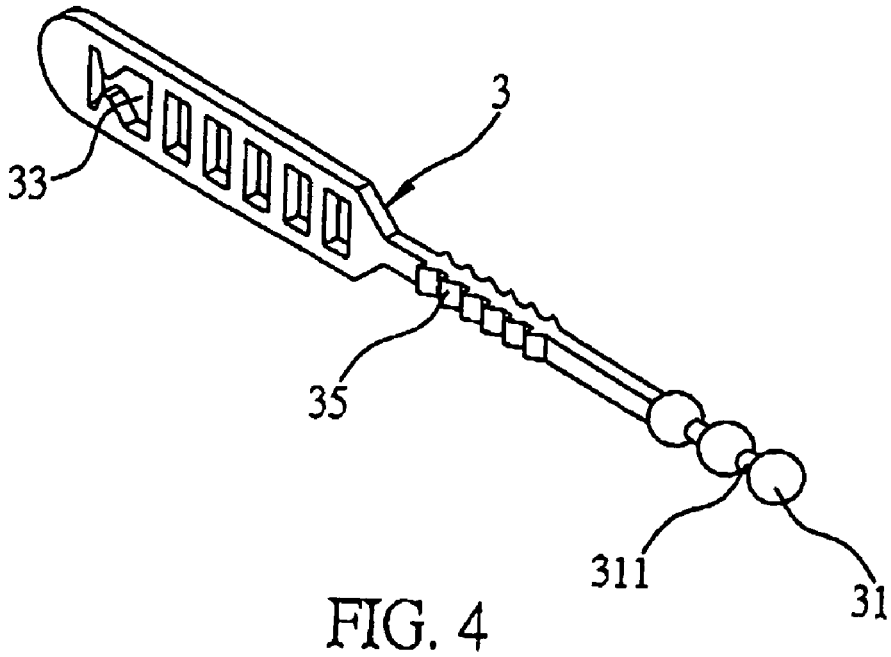
FIG. 4 is a schematic diagram showing a binding member of the plug fastening device according to the present invention.
Figure 5:
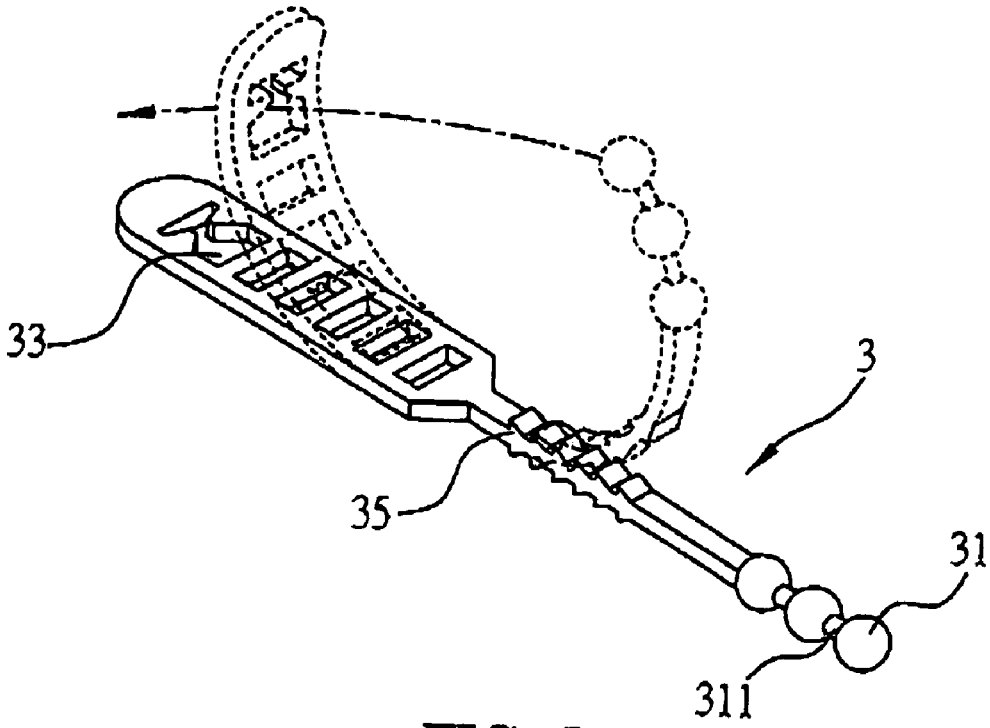
FIG. 5 is a schematic diagram showing the binding member at a bending status according to the present invention.

FIGS. 4 and 5 respectively show the binding member 3 of the plug fastening device and its bending status according to the present invention. The binding member 3 is for example a strip structure, which is preferably made of a plastic material and has appropriate strength, tenacity and elasticity. In this embodiment, the binding member 3 comprises a plurality of second coupling portions 31 connected to each other, wherein the second coupling portions 31 can be coupling bumps having for example a spherical structure, and connecting portions 311 such as cylinder structures are provided between the adjacent second coupling portions 31 to connect the second coupling portions 31 to each other. The size (diameter) of the connecting portions 311 is much smaller than that of the second coupling portions 31.

The binding portion 3 further comprises at least one through hole 33 distant from the second coupling portions 31 and for the second coupling portions 31 to pass therethrough. In this embodiment, the binding member 3 comprises a plurality of through holes 33 spaced from each other. The binding member 3 further comprises an inversed-hook structure 35 located between the second coupling portions 31 and the through holes 33, wherein the inversed-hook structure 35 has a saw-toothed shape. When the binding portion 3 is bent to allow the second coupling portions 31 to pass through one of the through holes 33, the inversed-hook structure 35 can be fixed and hooked to two sides of the through hole 33.

Figure 6:
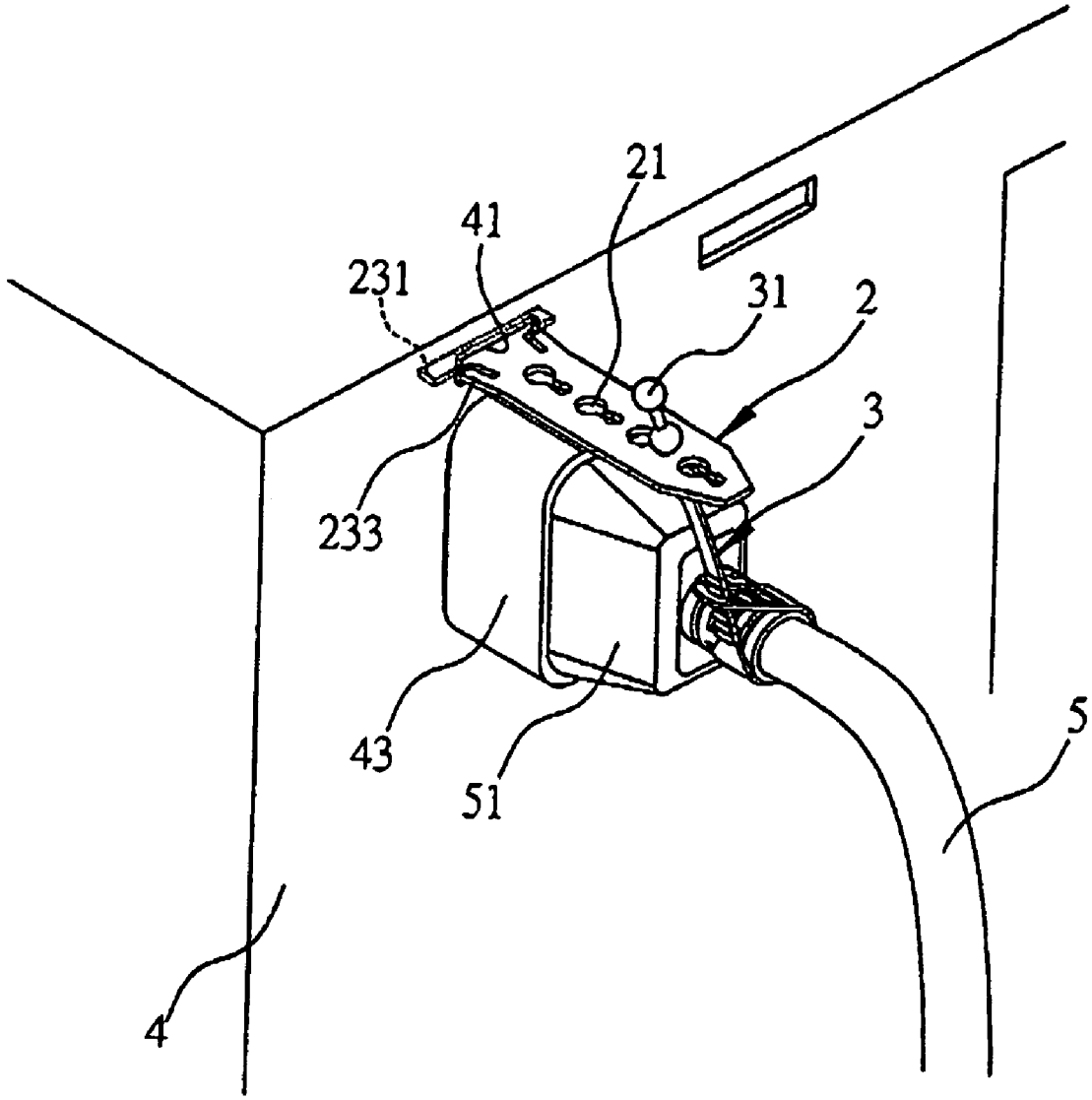
FIG. 6 is a schematic diagram showing the plug fastening device being in use according to the present invention.

FIG. 6 is a schematic diagram showing the plug fastening device being in use according to the present invention. As shown in FIG. 6, the plug fastening device is applicable to a socket-forming side 4 with a first fixing portion 41. The first fixing portion 41 is an opening having for example a slender rectangular shape. The socket-forming side 4 is for example a back side of a casing of a computer host or server host. A socket 43 formed on the socket-forming side 4 is for example a power socket for a power supplier in the host and can be coupled to a plug 51 of a transmission wire 5, wherein the transmission wire 5 is for example a power wire or a signal wire. It should be noted that the plug fastening device according to the present invention may be applied to any socket-forming side with the first fixing portion 41 besides the socket-forming side 4 of the computer or server, and there is no particular limitation on the types of the socket 43 and the plug 51 of the transmission wire 5. The present invention is not limited to the using status in this embodiment.

The fixing member 2 is fixed to the first fixing portion 41 of the socket-forming side 4 by the second fixing portion 23. In particular, the fixing member 2 is allowed to pass through the first fixing portion 41 from inside to outside of the casing until the blocking portion 231 abuts against the socket-forming side 4, wherein the two elastic members 233 of the second fixing portion 23 when passing through the first fixing portion 41 are elastically pressed by sides of the first fixing portion 41, and then the elastic members 233 are restored by elasticity thereof after passing through the first fixing portion 41, such that the socket-forming side 4 is fixed between the blocking portion 231 and the elastic members 233. On the contrary, if it is necessary to separate the fixing member 2 from the socket-forming side 4, it can be done by pressing the elastic members 233 and moving the fixing member 2 from outside to inside of the casing so as to detach the fixing member 2 from the first fixing portion 41.

The binding member 3 is bent to firmly bind and hold an end (e.g. a rear end) of the plug 51 or the transmission wire 5 at the end of the plug 51 by allowing the second coupling portion 31 to pass through an appropriate one of the through holes 33 and allowing the inversed-hook structure 35 to be fixed and hooked to two sides of the through hole 33. After the plug 51 is plugged into the socket 43, the second coupling portion 31 can be coupled to an appropriate one of the first coupling portions 21 to ensure the plug 51 being fixed to the socket 43, which is easily accomplished as the fixing member 2 and the binding member 3 both have appropriate strength, tenacity and elasticity. Therefore, the combination of the fixing member 2 and the binding member 3 ensures that the plug 51 is fixed to the socket 43, and the plug 51 cannot be unplugged from the socket 43 at such status, thereby preventing undesirably artificial or accidental disconnection of the plug 51 from the socket 43. On the other hand, if it is necessary to unplug the plug 51 from the socket 43, it can be done by detaching the second coupling portion 31 from the first coupling portion 21.

As the binding member 3 can be freely bent to bind the end of the plug 51 or the transmission wire 5 at the end of the plug 51, it is applicable to all kinds of plugs or transmission wires with different specifications, such that the drawback in the prior art that the conventional plug fastening device cannot be universally used is overcome.

In the foregoing embodiment, the first coupling portion 21 of the fixing member 2 is a coupling hole and the second coupling portion 31 of the binding member 3 is a coupling bump. Alternatively, in another embodiment, the first coupling portion 21 of the fixing member 2 may be a coupling bump having for example a spherical structure, and the second coupling portion 31 of the binding member 3 may be a corresponding coupling hole having for example a gourd-like shape. Such modification in design achieves the same effect as the foregoing embodiment and should be understood by a person skilled in the art, thereby not being illustrated by drawings.

Therefore, the plug fastening device of the present invention utilizes the combination of the fixing member and the binding member to ensure the plug being fixed to the socket such that the plug cannot be unplugged from the socket at such status, thereby preventing undesirably artificial or accidental disconnection of the plug from the socket. Moreover, as the binding member can be freely bent to bind the end of the plug or the transmission wire at the end of the plug, it is applicable to all kinds of plugs or transmission wires with different specifications, such that the drawback in the prior art that the conventional plug fastening device cannot be universally used is overcome.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A plug fastening device applied to a socket-forming side having a first fixing portion, the plug fastening device comprising:

a fixing member comprising at least one first coupling portion, and a second fixing portion for being fixed to the first fixing portion, the second fixing portion comprising a blocking portion provided at an end of the fixing member and a first elastic member provided at a first side of the fixing member and adjacent to the blocking portion; and a binding member for binding an end of a plug, and having at least one second coupling portion for being coupled to the first coupling portion.

2. The plug fastening device of claim 1, wherein the fixing member comprises a plurality of first coupling portions spaced from each other.

3. The plug fastening device of claim 2, wherein the first coupling portions are coupling holes.

4. The plug fastening device of claim 1, wherein the second fixing portion further comprises a second elastic member provided at a second side of the fixing member and adjacent to the blocking portion.

5. The plug fastening device of claim 1, wherein the fixing member is a plate structure.

6. The plug fastening device of claim 1, wherein the fixing member comprises a plurality of first coupling portions connected to each other.

7. The plug fastening device of claim 6, wherein the first coupling portions are coupling bumps.

8. The plug fastening device of claim 1, wherein the binding member comprises a plurality of second coupling portions connected to each other.

9. The plug fastening device of claim 8, wherein the second coupling portions are coupling bumps.

10. The plug fastening device of claim 1, wherein the binding member comprises a plurality of second coupling portions spaced from each other.

11. The plug fastening device of claim 10, wherein the second coupling portions are coupling holes.

12. The plug fastening device of claim 1, wherein the binding the member further comprises at least one through hole distant from the second coupling portion and for the second coupling portion to pass therethrough.

13. The plug fastening device of claim 12, wherein the binding member comprises a plurality of through holes spaced from each other.

14. The plug fastening device of claim 12, wherein the binding member further comprises an inversed-hook structure located between the second coupling portion and the through hole.

15. The plug fastening device of claim 14, wherein the inversed-hook structure has a saw-toothed shape.

16. The plug fastening device of claim 1, wherein the binding member is capable of binding a transmission wire at the end of the plug.

17. The plug fastening device of claim 16, wherein the transmission wire is one of a power wire and a signal wire.

18. The plug fastening device of claim 1, wherein the first fixing portion is an opening formed on the socket-forming side.

19. The plug fastening device of claim 18, wherein the opening has a slender rectangular shape.

20. A plug fastening device applied to a socket-forming side having a first fixing portion, the plug fastening device comprising:

a fixing member comprising a plurality of coupling bumps connected to each other, and a second fixing portion for being fixed to the coupling bumps; and a binding member for binding an end of a plug, and having at least one second coupling portion for being selectively coupled to one of the coupling bumps.

21. A plug fastening device applied to a socket-forming side having a first fixing portion, the plug fastening device comprising:

a fixing member comprising at least one first coupling portion, and a second fixing portion for being fixed to the first fixing portion; and a binding member for binding an end of a plug, and having a plurality of coupling holes spaced from each other for being coupled to the first coupling portion.

22. A plug fastening device applied to a socket-forming side having a first fixing portion, the plug fastening device comprising:

a fixing member comprising at least one first coupling portion, and a second fixing portion for being fixed to the first fixing portion; and a binding member for binding an end of a plug, and having at least one second coupling portion for being coupled to the first coupling portion, and a plurality of through holes spaced from each other.

23. A plug fastening device applied to a socket-forming side having an opening formed on the socket-forming side and having a slender rectangular shape, the plug fastening device comprising:

a fixing member comprising at least one first coupling portion, and a second fixing portion for being fixed to the first fixing portion; and a binding member for binding an end of a plug, and having at least one second coupling portion for being coupled to the first coupling portion.

* * * * *